United States Patent [19]

Rendell et al.

[11] 4,027,570

[45] June 7, 1977

[54] NECK-BODY JOINT FOR GUITAR-LIKE INSTRUMENTS

[75] Inventors: Stanley E. Rendell; Richard Schneider, both of Kalamazoo, Mich.

[73] Assignee: Norlin Music, Inc., Lincolnwood, Ill.

[22] Filed: May 12, 1975

[21] Appl. No.: 576,326

[52] U.S. Cl. ..... 84/293; 84/267; 84/291

[51] Int. Cl.[2] ..... G10D 3/01; G10D 1/08; G10D 3/00

[58] Field of Search ..... 84/293, 291, 267

[56] References Cited

UNITED STATES PATENTS

| | | | |
|---|---|---|---|
| 465,490 | 12/1891 | Olson | 84/293 |
| 893,632 | 7/1908 | Koch | 84/291 |
| 1,074,458 | 9/1913 | Pileri | 84/293 |
| 2,299,923 | 10/1942 | Nall | 84/267 |
| 3,521,374 | 7/1970 | Reynolds | 84/267 |

FOREIGN PATENTS OR APPLICATIONS

| | | | |
|---|---|---|---|
| 516,455 | 2/1955 | Italy | 84/293 |
| 151,283 | 8/1955 | Sweden | 84/293 |

*Primary Examiner*—Stephen J. Tomsky

[57] ABSTRACT

This invention relates to an improved neck-body joint for a guitar-like musical instrument which joint minimizes the possibility of relative movement between the neck and body and permits the neck to be pitched at a desired angle relative to the body without weakening either element. The firm joint is achieved by (a) providing a tongue which extends from the end of the neck and a recess in the upper surface of the endblock, the recess being positioned and sized so as to permit the tongue to fit snugly therein and be secured therein when the neck and body are fully assembled; (b) providing a dove-tail projecton on the end of the neck which mates with a dove-tail channel formed at the mating end of the headblock and (c) reinforcing the body at a point substantially under the last fret of the fingerboard, such reinforcing being accomplished by securing first and second reinforcing bars respectively to the inside surfaces of the soundboard and the bottom board of the body at the point under the last fret with these bars extending from one sidewall of the body to the other, and attaching reinforcing bars to each of the sidewalls, the bars extending between and being connected to both the first and second reinforcing bars. The desired pitch angle for the neck is achieved by utilizing a soundboard having a large angle curve, the neck being pitched such that its upper surface is in a plane tangent to the curvature of the soundboard at the back end thereof.

13 Claims, 4 Drawing Figures

14
10
36
28
34
32
24
34
30
26
46
40
46
42
22
20
20
16
18
12

NECK-BODY JOINT FOR GUITAR-LIKE INSTRUMENTS

BACKGROUND

1. Field of the Invention

This invention relates to guitar-like musical instruments and more particularly to an improved neck-body joint for such instruments.

2. The Prior Art

In a guitar or similar instrument, the joint between the neck of the instrument and the body of the instrument must be as firm as possible since any movement along this joint can cause both variations in string height, (decreases in this height causing spurious contact with the frets and thus possible buzzing of the instrument) and variations in string length (and thus in the intonation of the instrument.) However, in spite of the criticality of this joint, it has heretofore normally been accomplished with a glued butt joint. Sometimes a single dove-tail is included for reinforcement. These joints have not, however, provided the requisite strength to minimize movement along the joint.

This joint also controls the angle or pitch of the neck, and thus the fingerboard relative to the instrument body. If the plane of the fingerboard is the same as that of the guitar top, then a relatively low bridge (just slightly greater in height than the height of the fingerboard,) must be utilized. However, for optimum sound output, it is desirable that a higher bridge be utilized. Further, with this pitch, the player must reach out with his left arm when playing, a position which is less comfortable than if the arm could be positioned back closer to the player's body.

In view of the above, some manufacturers have pitched the instrument neck and fingerboard at a slight angle to the top of the instrument. However, in order to do this, they have had to taper either the fingerboard or the top (i.e. soundboard) of the instrument, either of which tends to weaken the neck-body joint and/or the soundboard.

A need therefore exists for an improved neck body joint for guitar-like musical instrument which is strong enough to prevent any movement along the joint while still permitting the neck of the instrument to be pitched at a desired angle relative to the instrument body.

SUMMARY OF THE PRESENT INVENTION

In accordance with the above, this invention provides a guitar-like musical instrument having a body with a soundboard forming its upper surface and a headblock secured in the back thereof, a neck extending from the back of the body. The neck-body joint includes a tongue which extends from the upper portion of the end of the neck adjacent to body and a recess formed in the upper surface of the headblock, the recess being sized and positioned so as to permit the tongue to fit snugly therein and be secured therein when the neck and body are assembled. The tongue may either be an integral part of the neck or a recess may be provided in the upper surface of the neck, the recess extending from the surface of the neck in contact with the body, and a separate tongue may be provided which is sized to fit snugly and be secured in both of the recesses when the neck and body are fully assembled. There is also a dovetail projection extending from the end of the neck adjacent the body and a dovetail channel formed in the headblock, the channel being positioned opposite the projection on the neck and being sized to have the projection fit snugly therein when the neck and body are assembled. The body also includes sidewalls interconnecting the soundboard with a bottom board to form an enclosed structure, a fretted fingerboard being secured over the neck and a portion of the back of the soundboard. First and second reinforcing bars attached respectively to the soundboard and the bottom board at a point just beyond the end of the headblock and substantially under the end of or the last fret of the fingerboard extend from one sidewall to the other. A reinforcing bar is also attached to each of the sidewalls, these bars each extending between and being connected to both the first and second reinforcing bars to form a means for reinforcing the body. The soundboard is slightly curved and the neck is pitched such that its upper surface is in a plane tangent to the curvature of the soundboard at the back end thereof. For a preferred embodiment of the invention the soundboard is flat starting at a point just beyond the end of the fingerboard at an angle tangent to the curve of the soundboard at that point.

The foregoing and other objects, features and advantages of the invention will be apparent from the following more particular description of preferred embodiments of the invention as illustrated in the accompanying drawings.

DETAILED DESCRIPTION

Figure 1:
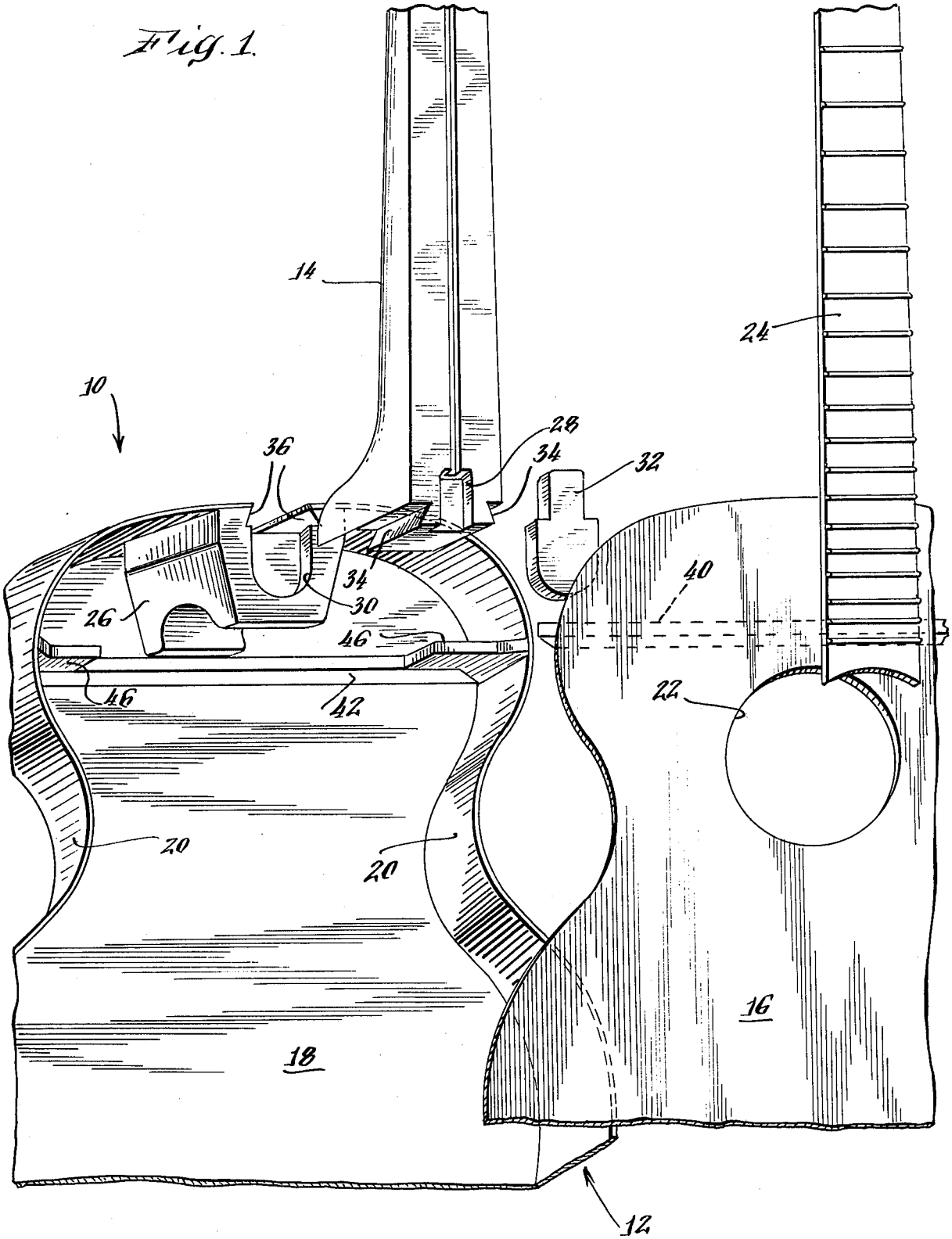
FIG. 1 is a partially exploded perspective view of a guitar employing the teachings of this invention.

Referring now to the figures, it is seen that the guitar 10 of this invention consists of a guitar body 12 having a neck 14 extending therefrom. Body 12 is an enclosed structure the top surface of which is a soundboard 16 and the bottom surface of which is a bottom board 18. The top and bottom boards are interconnected by sidewalls 20. Soundboard 16 has a slight curvature (with for example a 20 foot radius) in the area in front of soundhole 22. Starting at the back edge of soundhole 22, the soundboard is flat, the plane of the soundboard in this area being at an angle substantially tangent to the curvature of the soundboard at the point where the soundboard flattens. A fretted fingerboard 24 is secured over neck 14 and extends over the rear portion of soundboard 16, terminating just short of soundhole 22. Since fingerboard 24 rests on top of the flattened portion of soundboard 16, the pitch or angle of the fingerboard, and thus of the neck to which it is secured, is at an angle of 2° or 3° to the horizontal. The desired pitch angle for the neck is thus achieved without requiring a thinning of either the soundboard or the fingerboard.

A headblock 26 is secured in the back end of body 12. A recess 28 is formed at the forward end of the top of fingerboard 14 and an enlarged recess 30 is also formed in the rear end of the top of headblock 26. A tongue 32 which is sized so as to fit snugly in both recesses 28 and 30 is secured in these recesses by suitable means. For a preferred embodiment of the invention, tongue 32 is glued into the recesses; however, for extra strength, screws may be utilized in addition to or instead of gluing.

A dovetail projection 34 is formed at the forward end of neck 14 and a mating dovetail channel 36 is formed in the rear end of headblock 26. The lower surfaces of both projection 34 and channel 36 are at an angle such as 18°.

Figure 2:
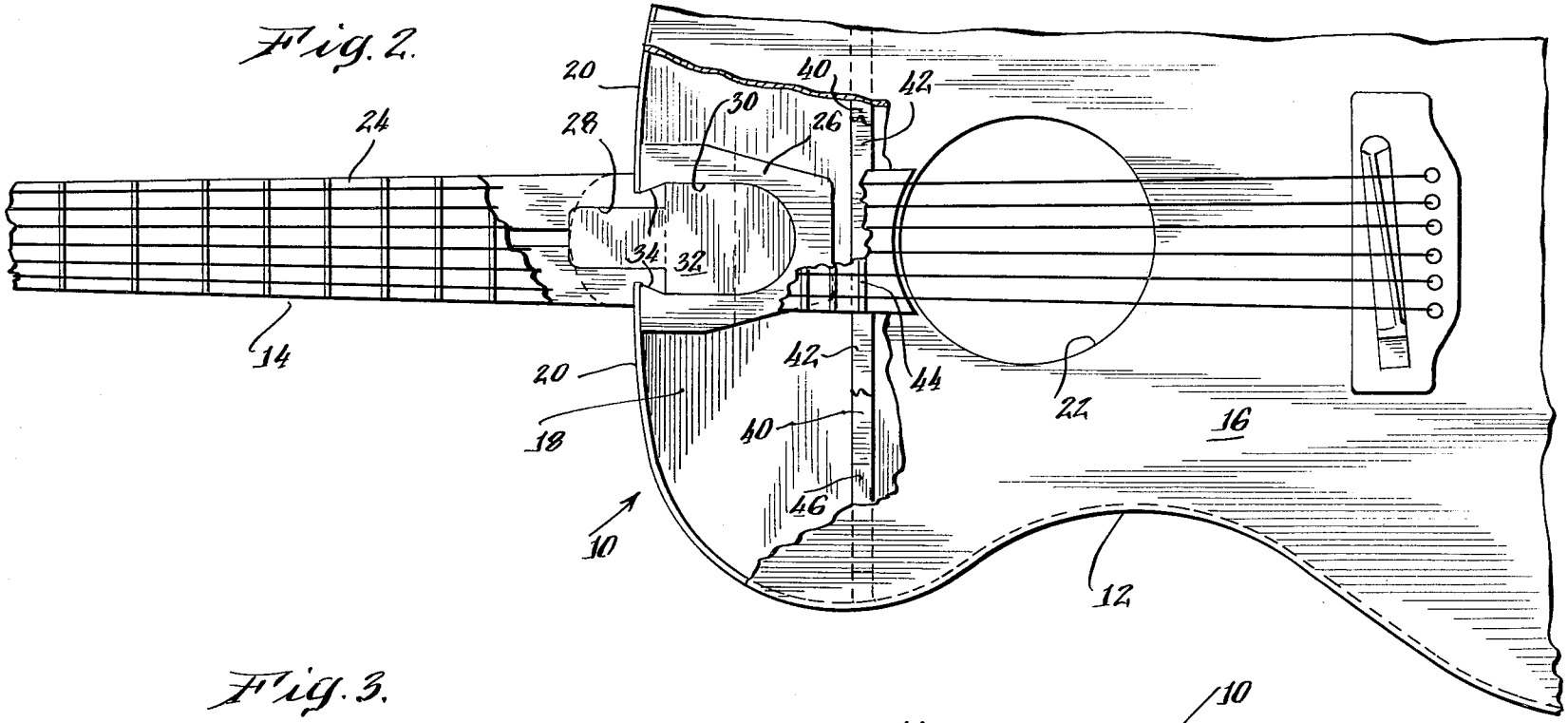
FIG. 2 is a partially cut away top view of a portion of the guitar shown in FIG. 1.
Figure 3:
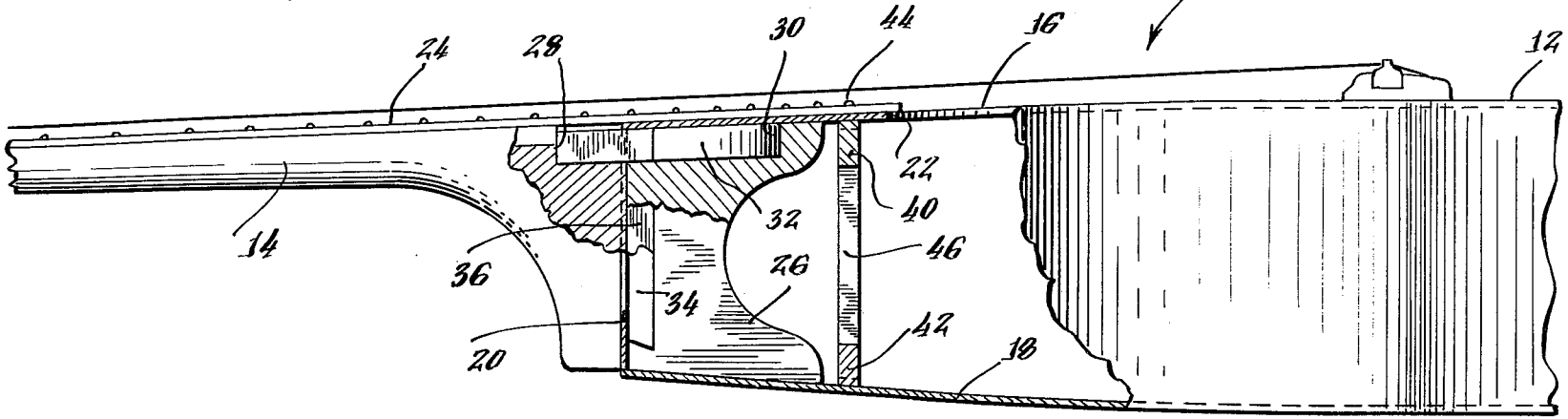
FIG. 3 is a partially cut away side view of the portion of the guitar shown in FIG. 2.

When the neck body joint of the instrument 10 is assembled as shown in FIGS. 2 and 3, the combination of the dovetail joint formed by projection 34 and channel 36, and tongue 32 in recesses 28 and 30 provides a strong joint which is extremely resistant to movement in all directions, the neck being locked against movement relative to the headblock and thus the body. However, one additional reinforcing element is provided to further protect against any upward movement of the neck relative to the instrument body. It is noted that any upward movement of neck 14 relative to the body would cause fingerboard 24 to bear down on the top of soundboard 16. In order to prevent such movement, reinforcing bars 40 and 42 are secured, preferably by gluing, to the inside surfaces of soundboard 16 and bottom board 18 respectively, the bars being positioned just beyond the end of head block 26 and substantially under the last fret 44 on fingerboard 24. Bars 40 and 42 each extend from one wall 20 to the opposite wall 20 of the body. A bar 46 is secured to each of the walls 20 at a point between bars 40 and 42, each of the bars 46 extending between and being connected to both of the bars 40 and 42. Thus, a sold reinforcing brace is provided near the end of the fingerboard to prevent buckling of soundboard 16 in the area under the fingerboard and thus to further protect against downward movement of the fingerboard.

Figure 4:
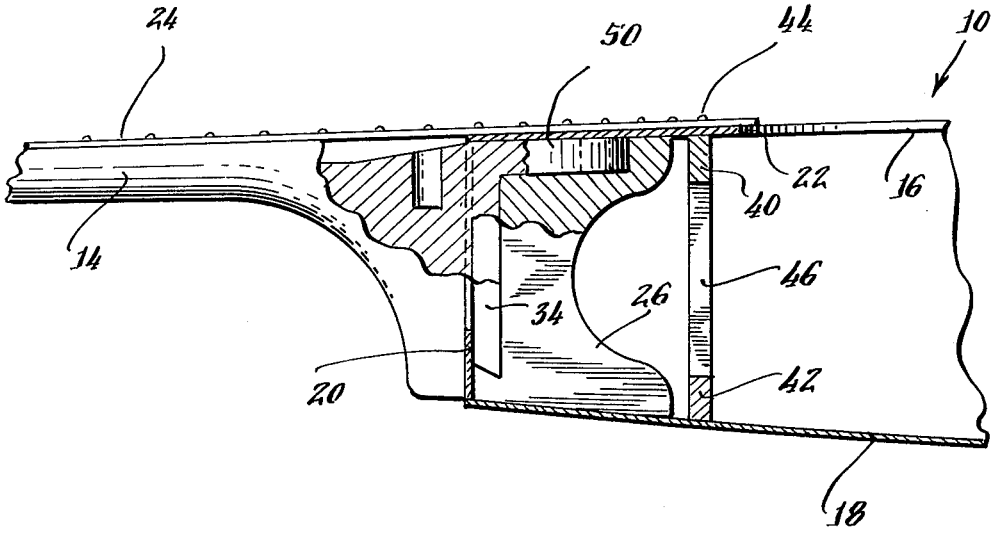
FIG. 4 is a side view of the end of the neck for an alternative embodiment of the invention.

FIG. 4 shows the front portion of the neck for an alternative embodiment of the invention wherein the recess 28 in fingerboard 14 and tongue 32 have been replaced by a tongue 50 which is formed as an integral part of neck 14. The advantage of the embodiment of the invention shown in FIG. 4 is that it provides a more secure joint between the neck and tongue and that it is easier to assemble. However, a larger blank is required to form the neck in this manner with there being a greater amount of wood wastage.

A guitar has thus been provided which has an extremely firm neck body joint while still permitting the neck of the instrument to be pitched at a desired angle relative to the body. While the invention has been particularly shown and described above with respect to particular guitar embodiments thereof, it is apparent that the invention could be practiced with other similar instruments and that various changes could be made in form and detail while still remaining within the spirit and scope of the invention.

What is claimed is:

1. In a guitar-like musical instrument having a body with a soundboard forming its upper surface and a headblock secured in the back end thereof and a neck extending from the back of the body, a neck-body joint including:

a tongue extending from the upper portion of the end of the neck which end is in contact with the body;

a recess formed in the upper surface of the head block at a position opposite said tongue, said recess being sized to permit said tongue to fit snugly therein, said tongue being firmly secured in said recess when said neck and body are fully assembled;

a dovetail projection extending from the end of said neck adjacent to the body; and a dovetail channel formed in said headblock, said channel being positioned opposite the projection of said neck and being sized to have said projection fit snugly therein when said neck and body are assembled.

2. A joint as claimed in claim 1 wherein said tongue is formed as an integral part of said neck.

3. A joint as claimed in claim 1 including a recess formed in the upper surface of said neck, said recess extending from the surface of the neck in contact with the body; and wherein said tongue is a separate member which is sized to fit snugly and be firmly secured in both the recess in said neck and the recess in said headblock when the neck and body are fully assembled.

4. A joint as claimed in claim 3 wherein said tongue is secured in said recesses by being glued therein.

5. A joint as claimed in claim 1 wherein said projection and said channel are of substantially the same height as the end of the neck and the headblock respectively.

6. A joint as claimed in claim 1 wherein said body includes side walls interconnecting said soundboard with a bottom board to form an enclosed structure; and including first and second reinforcing bars attached respectively to said soundboard and said bottom board at a point just beyond the end of said headblock and extending from one side wall to the other, and a reinforcing bar attached to each of said side walls, said bars each extending between and being connected to both said first and second reinforcing bars.

7. A joint as claimed in claim 1 including a fretted fingerboard secured over said neck and a portion of the back of the soundboard; and including means for reinforcing said body at a point substantially under the last fret of the fingerboard.

8. A joint as claimed in claim 7 wherein said body includes side walls interconnecting said soundboard with a bottom board to form an enclosed structure; and wherein said means for reinforcing includes first and second reinforcing bars attached respectively to said soundboard and to said bottom board and extending from one side wall to the other, and a reinforcing bar attached to each of said side walls, said bars each extending between and being connected to both said first and second reinforcing bars.

9. A joint as claimed in claim 1 wherein the soundboard is slightly curved; and wherein said neck is pitched such that its upper surface is in a plane tangent to the curvature of the soundboard at the back end thereof.

10. A joint as claimed in claim 9 including a fretted fingerboard secured over said neck and a portion of the back of the soundboard; and wherein the soundboard is flattened starting at a point just beyond the end of the fingerboard at an angle tangent to the curve of the soundboard at that point.

11. A joint as claimed in claim 10 including means for reinforcing said body at a point under the last fret of the fingerboard.

12. A guitar-like musical instrument comprising:

a body with a soundboard forming its upper surface;

a neck extending from the back of the body; and a fretted fingerboard of substantially uniform thickness attached to the top of said neck and attached to and in physical contact with the top of a portion of the back-end portion of the soundboard;

the soundboard being slightly curved from the front end thereof to a point just in front of the end of the fingerboard and being flattened from that point back at an angle tangent to the curve of the soundboard at that point, the fingerboard thus being attached to a flattened portion of the soundboard; and the neck and fingerboard being pitched in a plane parallel to the flattened portion of the soundboard.

13. An instrument as claimed in claim 12 wherein the radius of curvature of said soundboard is in the order of 20 feet.

* * * * *